US010480836B2

(12) United States Patent
Achatz et al.

(10) Patent No.: US 10,480,836 B2
(45) Date of Patent: Nov. 19, 2019

(54) DEVICE FOR FILLING VEHICLE AIR CONDITIONING SYSTEMS WITH REFRIGERANT R744

(71) Applicant: DÜRR SOMAC GmbH, Stollberg (DE)

(72) Inventors: Thomas Achatz, Niederdorf (DE); Jörg Ritter, Aue (DE)

(73) Assignee: DÜRR SOMAC GmbH, Stollberg (DE)

( * ) Notice: Subject to any disclaimer, the term of this patent is extended or adjusted under 35 U.S.C. 154(b) by 302 days.

(21) Appl. No.: 15/325,569

(22) PCT Filed: Jul. 1, 2015

(86) PCT No.: PCT/DE2015/000338
§ 371 (c)(1),
(2) Date: Apr. 3, 2017

(87) PCT Pub. No.: WO2016/011990
PCT Pub. Date: Jan. 28, 2016

(65) Prior Publication Data

US 2017/0227270 A1 Aug. 10, 2017

(30) Foreign Application Priority Data

Jul. 22, 2014 (DE) ..... 10 2014 011 051

(51) Int. Cl.
*F25B 45/00* (2006.01)

(52) U.S. Cl.
CPC ..... *F25B 45/00* (2013.01); *F25B 2345/003* (2013.01)

(58) Field of Classification Search
CPC ..... F25B 45/00; F25B 2345/003
See application file for complete search history.

(56) References Cited

U.S. PATENT DOCUMENTS 4,285,206 A 8/1981 Koser
5,024,061 A 6/1991 Pfeil, Jr. et al.
(Continued)

FOREIGN PATENT DOCUMENTS

EP 2762804 A1 8/2014

OTHER PUBLICATIONS

International Search Report (German and English) for PCT/DE2015/000338, ISA/EP, Rijswijk, NL, dated Dec. 15, 2015.
(Continued)

*Primary Examiner* — Ana M Vazquez
(74) *Attorney, Agent, or Firm* — Harness, Dickey & Pierce, P.L.C.

(57) ABSTRACT

Apparatus for filling an automobile air conditioning system with refrigerant in a liquid state is disclosed. R744 refrigerant is pumped in a liquid state from a storage tank to a refrigerant filling station having an inlet and two outlets. A first outlet is connected to a first refrigerant return line back to the storage tank. A second outlet is connected to an adapter for attaching to a service port of the air conditioning system during filling. An adapter support that has a connection port substantially the same as the service port receives the adapter when it is in a storage position. A valve is connected to the inlet and the first outlet and a temperature sensor measures a temperature of the refrigerant at the inlet. When the temperature is above a threshold, the valve closes the inlet and connects the refrigerant supply line to the first refrigerant return line.

4 Claims, 1 Drawing Sheet

(56) References Cited

U.S. PATENT DOCUMENTS

| | | | |
|---|---|---|---|
| 6,442,963 | B1 | 9/2002 | Pfefferle et al. |
| 9,488,397 | B2 | 11/2016 | Cording et al. |
| 2014/0216073 | A1 | 8/2014 | Cording et al. |

OTHER PUBLICATIONS

Written Opinion of the ISA for PCT/DE2015/000338, ISA/EP, Rijswijk, NL, (German) dated Dec. 15, 2015.

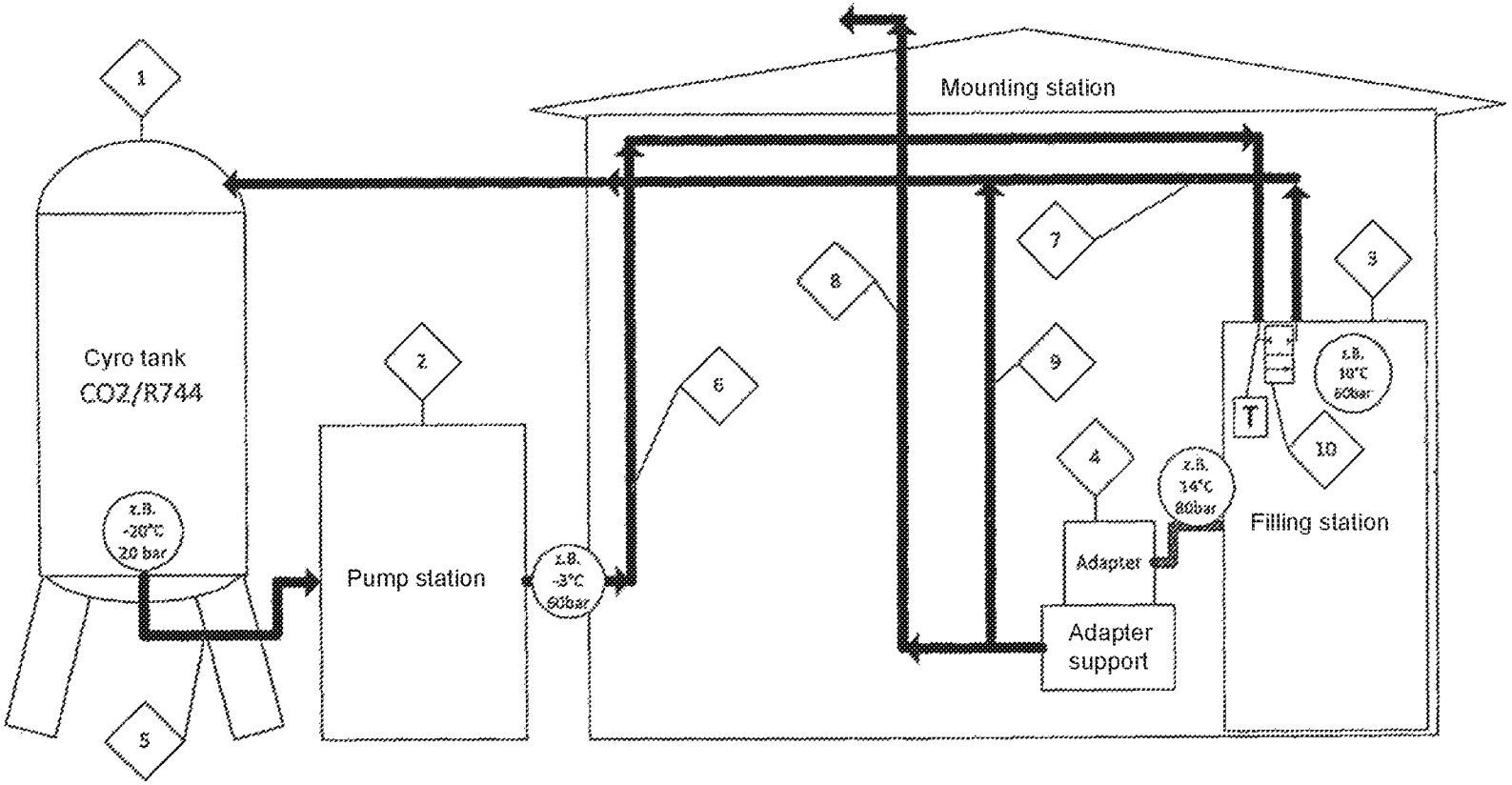
Mounting station
Filling station
Adapter
Adapter support
Pump station
Cyro tank
CO2/R744
z.B. -20°C 20 bar
z.B. -3°C 60bar
z.B. 14°C 60bar
z.B. 10°C 60bar
1
2
3
4
5
6
7
8
9
10

DEVICE FOR FILLING VEHICLE AIR CONDITIONING SYSTEMS WITH REFRIGERANT R744

CROSS-REFERENCE TO RELATED APPLICATIONS

This application is a 371 U.S. National Stage of International Application No. PCT/DE2015/000338, filed Jul.1, 2015, which claims the benefit of and priority to German Patent Application No. 10 2014 011 051.6, filed Jul. 22, 2014. The disclosures of the above applications are incorporated herein by reference.

FIELD

The invention relates to a device for filling vehicle climate systems with refrigerant R744. Said device comprises at least one storage tank for liquid refrigerant R744, which actively connected by means of at least one pump station, a supply line and a return line to a filling system from which the refrigerant R744 is fed by means of an adapter into the vehicle climate system.

BACKGROUND AND SUMMARY

For vehicle climate systems, refrigerants are increasingly used based on legal requirements, which meet environmentally friendly aspects. This also includes $CO_2$, which called R744 as a refrigerant.

The manufacturers of climate systems determine which mass is to be filled into the respective climate system. In this, the compliance with the required tight tolerances is of great importance in order not to impair the cooling performance and to avoid damage to the climate system by a different filling compound.

The vehicle climate systems first filled by the manufacturer in the vehicle assembly using filling systems. The accuracy requirements with respect to the masses be filled are therefore to be placed at the filling plant.

The properties of refrigerants described in enthalpy diagrams, from which correlations of pressure, temperature, density and phase states are recognizable.

Especially for refrigerant R744 manufacturers of filling systems are faced with the task of controlling the temperature and pressure changing phases of the process and thus also the density of the refrigerant, in order to be able to fill the required tolerance limits. However, this is particularly difficult with refrigerant R744 because significant changes are already occurring in the assembly room temperature range and in the case of compression by the required pumps.

From EP 2762804 A1 proposals are already known for detecting such changes and for calculating them during filling. However, these methods are very complex and require real-time correction during filling.

In principle, it would be advantageous if the refrigerant R744 could every time kept in the liquid phase. Here so-called mass flow meters are able to carry out correct measurements of the mass flow. The filling distance after the mass flow meter to the vehicle climate system can also considered as a constant volume and thus a constant mass, because the refrigerant is not subject to any significant density change in the liquid phase, given the enthalpy diagram in the liquid phase under slight temperature changes.

The aim of the invention is to provide a technical solution in which the refrigerant R744 can be maintained constantly in the liquid phase within said type of supply design.

The aim achieved in that a temperature sensor and a valve circuit are arranged at the transition area between the supply path and the filling system, which regulate the flow of the refrigerant as a function of the respective specific operating situation in such a way that the refrigerant which is heated by the take or is discharged and cold refrigerant is conveyed from the storage tank to the filling installation. The control of the valve circuit and, consequently, a return and / or cooling of the refrigerant is initiated by the filling system. In this case, the device triggers a return and / or cooling of the refrigerant only at times at which the application-specific operating behavior of the filling installation is not impaired. Furthermore, an adapter tray is designed in such a way that the adapter can be clamped in its storage position via a sealing form-fitting onto a special connection (service port) in such a way that a return and / or cooling of the refrigerant takes place via a return line assigned to the adapter tray. Advantageous embodiments are described in sub claims, the technical features of which are explained in an exemplary embodiment.

With a valve circuit and temperature monitoring, which assigned to the filling system, the refrigerant R744 held in its liquid phase. This makes it possible to fill the vehicle climate system with narrow tolerance limits, which can used with mass flow meters without additional real-time correction of line sections until entry into the climate system. By assigning the temperature monitoring and the valve circuit to the filling system, an automatic process is implemented, which takes the removal profile through the filling system on the assembly line and, for example, automatically establishes the operational readiness of the system on the supply concept at the beginning of the shift.

The filling distance up to the adapter is also considered. The adapter advantageously can bring into operative connection with a service port, which is similar to the vehicle valve, by means of a sealing form connection within the adapter tray. If the adapter tensioned accordingly in its support, a delivery of heated refrigerant and a re-delivery of cold refrigerant are automatically possible. As a result, a return line in the adapter and in the hose pack can advantageously dispensed with.

BRIEF DESCRIPTION OF DRAWINGS

An exemplary embodiment of the invention is described below with reference FIG. 1.

DETAILED DESCRIPTION

The device shown in the FIG. 1 designed for an initial filling of vehicle climate systems with refrigerant R744. The device has a storage tank 1 for liquid refrigerant R744, which is in operative connection via a line 5 and a pump station 2 as well as via a supply line 6 and a return line 7 with a filling system 3. Starting out from the filling system 3, the refrigerant R744 is feds into an assembly of the vehicle climate system via an adapter 4.

Tanks 1 for liquid refrigerant R744 with a connected pump station 2 as well as ring lines and return lines required for this are known from prior art, so that these modules need not be explained in detail at this point.

However, it is essential in the present situation automatically regulate the temperature and the pressure of the refrigerant R744, to consider the removal profile, and to keep the enthalpy diagram corresponding to the medium in a largely optimum range. For example, a range of 5°Celsius to 18°Celsius and a pressure position of 60 bar are mentioned here. If the refrigerant R744 can filled within these physical limits up to the filling opening into the vehicle climate system, filling without a complex real-time correction is possible with the aid of mass flow measurement technology.

This achieved by the supply system for the refrigerant R744 (hereinafter referred to as "medium") in addition to the supply line 6 a return line 7. A temperature sensor T and a valve circuit 10 arranged at the transfer of the supply line 6 to the filling system 3. For example, at a media removal pause the temperature, the heated medium can flow back with the aid of the valve circuit 10 and cold medium conveyed to the filling system 3. The allocation of the valve circuit 10 to the filling system 3 is advantageous because the latter known or controlled by it. In this way, a return or cool down of medium can always be carried out in times in which the required operating behavior is not impaired.

The filling line within the filling system 3 up to the adapter outlet has to also monitored with regard to the medium temperature and the pressure position. In order to dispense with a return line within the filling system 3, the adapter tray advantageously be designed in such a way that the adapter 4 is tensioned or sealed in the storage position onto a special connection similar to that of the vehicle system. Thus, medium can discharge over the same filling path and colder medium can fed via the supply section and the filling system 3. In this case, as well, the control is advantageously to left to the filling system 3, since the removal regime is known to it or is controlled by itself. In this way, a media return or cooling can also carried out at such times that the required operating behavior is not impaired. The transport or return transport of the medium may e.g. via a line 8 to the roof of the building or a return line 9 to the storage tank 1.

The invention claimed is:

1. An apparatus for filling an automobile air conditioning system with R744 refrigerant in a liquid state via a service port of the air conditioning system, the apparatus comprising:

a storage tank containing the R744 refrigerant in a liquid state;

a pump fluidly connected to the storage tank at a low pressure side of the pump and fluidly connected to a first end of a refrigerant supply line at a high pressure side of the pump, wherein the refrigerant supply line carries the R744 refrigerant in the liquid state at a pressure;

a refrigerant filling station comprising:

an inlet fluidly connected to a second end of the refrigerant supply line;

a first outlet fluidly connected to a first end of a first refrigerant return line, wherein the refrigerant return line includes a second end fluidly connected to the storage tank;

a second outlet fluidly connected to an adapter;

a valve fluidly connected to the inlet and the first outlet; and a temperature sensor operable to measure a temperature of the R744 refrigerant at the inlet;

wherein when a temperature of the R744 refrigerant measured by the temperature sensor is greater than a threshold temperature, the valve is in a first position wherein the valve opens the first outlet and fluidly connects the inlet to the first outlet such that the refrigerant supply line is fluidly connected to the first refrigerant return line; and wherein when a temperature measured by the temperature sensor is less than a threshold temperature, the valve is in a second position wherein the valve closes the first outlet; and wherein, in an operating position, the adapter is configured to be fluidly connected to the service port of the air conditioning system and direct the R744 refrigerant to the air conditioning system;

an adapter support comprising a connection port; and wherein, in a storage position, the adapter is fluidly connected and sealed to the connection port of the adapter support and directs the R744 refrigerant to the adapter support.

2. The apparatus of claim 1, wherein the adapter support is fluidly connected to at least one of a second refrigerant return line that is fluidly connected to the storage tank and a vent line open to atmosphere.

3. The apparatus of claim 2, wherein when the adapter is in the storage position, the adapter support directs the refrigerant to one of the second refrigerant return line and the vent line.

4. The apparatus of claim 1, wherein the threshold temperature is between 5 degrees Celsius and 18 degrees Celsius; and wherein the pressure is at least about 60 bar.

* * * * *